US006188421B1

(12) United States Patent
Hayashi et al.

(10) Patent No.: US 6,188,421 B1
(45) **Date of Patent: *Feb. 13, 2001**

(54) SEALING FILM WHOSE TEARING GUIDE IS FORMED BY LASER PROCESSING, AND TONER CONTAINER USING THE SAME

(75) Inventors: Kazuyoshi Hayashi, Sayama; Yoji Orimo, Sakado; Koji Shimizu, Omiya, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/711,791

(22) Filed: Sep. 10, 1996

(30) Foreign Application Priority Data

Sep. 11, 1995 (JP) ..... 7-258162

(51) Int. Cl.[7] ..... B41J 2/385; G03G 9/08
(52) U.S. Cl. ..... 347/155; 399/106
(58) Field of Search ..... 347/155, 156, 347/139, 262, 264; 399/102, 106

(56) References Cited

U.S. PATENT DOCUMENTS 4,615,612 10/1986 Ohno et al. .
4,931,838 6/1990 Ban et al. .
5,177,540 1/1993 Honda et al. .
5,296,902 3/1994 Michlin .
5,523,828 6/1996 De Kesel .
5,621,508 * 4/1998 McNamara ..... 399/106

FOREIGN PATENT DOCUMENTS 295 08 194 9/1995 (DE) .
0 540 184 5/1993 (EP) .
0 638 851 2/1995 (EP) .
59-13262 1/1984 (JP) .

* cited by examiner

*Primary Examiner*—John Barlow
*Assistant Examiner*—Raquel Yvette Gordon
(74) *Attorney, Agent, or Firm*—Fitzpatrick, Cella, Harper & Scinto

(57) ABSTRACT

The toner supplying opening of a toner container for storing powder toner or the like used in image-forming apparatuses such as copying machine or the like is sealed with a laminated lid material film. This sealing film comprises a base layer having tearing directionality, a guide layer having tearing guide portions formed by laser processing and a laser barrier layer provided between the base layer and the guide layer for shielding laser beams.

44 Claims, 3 Drawing Sheets

SEALING FILM WHOSE TEARING GUIDE IS FORMED BY LASER PROCESSING, AND TONER CONTAINER USING THE SAME

BACKGROUND OF THE INVENTION

1. Field of the Invention

The present invention relates to a toner container used in image-forming apparatuses such as copying machine or printers, and also relates to a sealing film for sealing an opening of such toner containers.

2. Related Background Art

Powder containers for storing a toner powder comprised of a formed container member and a lid material film are widely employed, as the structure of the opening can be manufactured in a simple manner, and moreover, an even greater degree of sealing can be achieved.

This sort of container is widely used particularly for toner containers for supplying a toner, as the lid material film can be peeled away after the container has been set in the apparatus such as a copying machine, thereby facilitating prevention of soiling due to scattered toner.

The method for removing the lid material film of such a toner container after the container has been set in the apparatus such as a copying machine, involves extending one end of the lid material film from a slit provided near a door of the copying machine, etc., for inserting and removing the toner container therefrom, thus allowing for the lid material film to be removed by means of extracting the edge of the lid material film. A common configuration employed in such an arrangement is to provide a portion of the lid material film, which is longer than the length of the container, and which is folded back over the aforementioned container.

Another method widely employed for such toner powder containers is in view of the toner capacity and other factors to seal the opening of the toner powder container and thereby seal the toner within, and then peel away part of the lid material film when opening a supplying orifice, which is smaller than the aforementioned container opening. An advantage of this method is that the opening in the lid material film can be maintained at a constant, regardless of the size of the toner container of the capacity thereof.

In such an arrangement, a supplying orifice must be opened in the lid material film so as to be smaller than the container opening and to be at a set position. For example, in Japanese Patent Application Laid-Open No. 59-13262 there is disclosed an example of lid material film for a toner container which has such an opening. The lid material film is comprised of a lid material film which is approximately the same size as the formed opening of the toner container, and a lid material film formed along a supplying opening which is smaller than the formed opening of the toner container, the later smaller lid material film is laid upon the former. Thus an opening is formed along the lid material film upon peeling-away, thereby enabling an opening to be obtained in a constant manner.

Further, in U.S. Pat. No. 4,931,838, there is disclosed a processing cartridge wherein an opening is formed between the toner cartridge and the developer by means of pulling tear-tape which is applied as backing to the cover film. However, such methods require two sheets of film, making the sealing structure complicated. Accordingly, there has been proposed a method for tearing the film along an intermittent line of perforations (machine sewing line), but there are problems such as the resulting opening being imprecise in dimensions, and the fine toner particles leaking from the perforations.

SUMMARY OF THE INVENTION

Accordingly, it is an object of the present invention to provide sealing film and a toner container enabling sealing of the opening of the toner container with a simple construction.

Another object of the present invention is to provide sealing film and a toner container wherein the opening formed by tearing of the film is highly precise with regard to dimensions.

A further object of the present invention is to provide sealing film comprising a base layer having tearing directionality, a guide layer having tearing guide portions formed by laser processing, and a laser barrier layer provided between the base layer and the guide layer, and a toner container employing the same.

Other and further objects of the present invention will become obvious from the following description.

DESCRIPTION OF THE PREFERRED EMBODIMENTS

Figure 1:
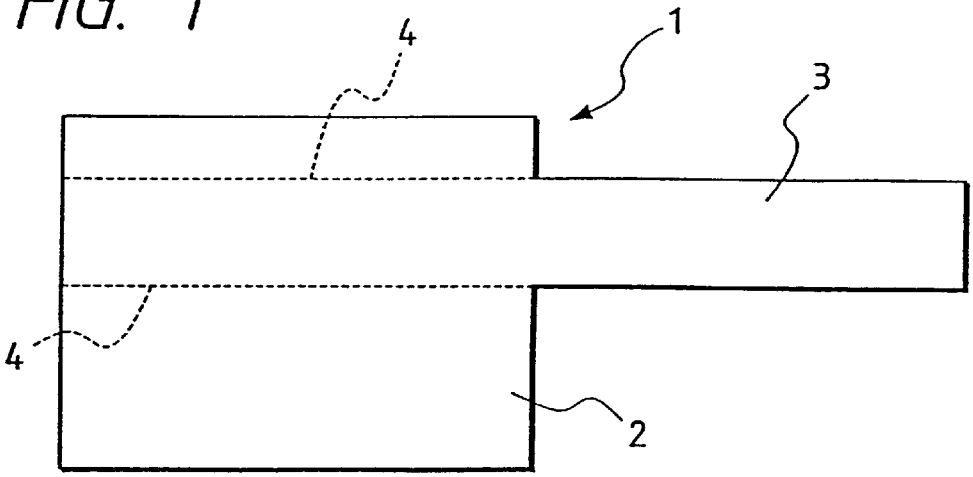
FIG. 1 is a plan view of an example of lid material film for a toner container.

First, description of the lid material film for the toner container according to the present invention will be made with reference to the attached drawings. FIG. 1 is a plan view of an example of lid material film for a toner container according to the present invention, in which a lid material film 1 for the toner container comprises a lid portion 2, which seals the opening of the toner container, and a gripping portion 3 for pulling with the hand or the like when opening. The lid material film 1 further comprises at least one or more laser-processed lines 4, which serve as tearing guides and which are provided upon a straight extension of the gripping portion 3 and the same width as the gripping portion 3. Further, the lid material film for the toner container, which serves as the sealing film according to the present invention, is a multi-layered film, wherein specific films are layered.

Figure 2A:
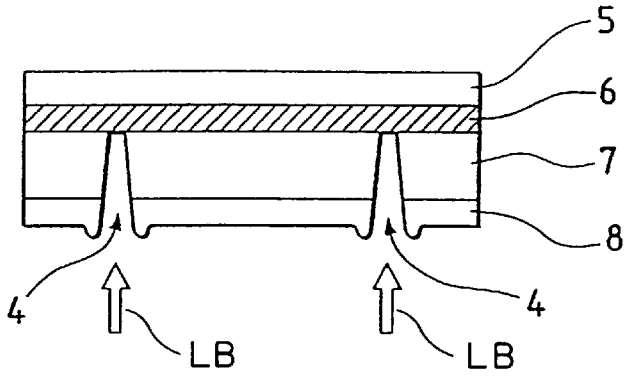
FIG. 2A is a cross sectional view of the layer configuration of an example of lid material film for a toner container.
Figure 2B:
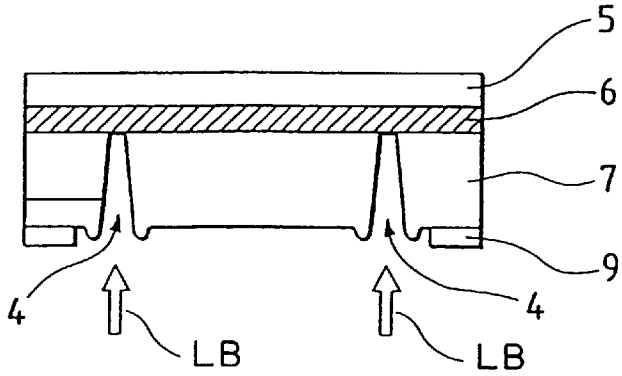
FIG. 2B is a cross sectional view of the layer configuration of an example of lid material film for a toner container.

FIGS. 2A and 2B are cross-sectional diagrams showing the layered configuration of one example of the lid material film for toner containers according to the present invention. That is, as shown in FIG. 2A, the lid material film according to the present invention comprises a heat-resistant base film layer 5 having tearing directionality, a laser barrier layer 6, which is not processed by the laser beam, a guide layer 7 having tearing guide portions formed by laser processing, and an adhesive layer 8, in order from the outermost layer.

Alternately, as shown in FIG. 2B, the lid material film according to the present invention may comprise a heat-resistant base film layer 5 having tearing directionality, a layer 6 which is not processed by the laser beam; a guide layer 7 having tearing guide portions formed by laser processing, and an adhesive agent layer 9, in order from the outermost layer.

In the aforementioned FIGS. 2A and 2B, reference numeral 4 denotes the grooves or slits serving as laser-processed lines formed by laser irradiation which act as tearing guides for opening, and reference letter R denotes the laser beam.

The aforementioned example is a preferred embodiment of two or three examples of the present invention, and the present invention is by no means limited to them. Also, in the case of the aforementioned FIG. 2B, the adhesive agent layer 9 needs only to be provided to portions corresponding with the flanged opening of the toner container, that is, there is no need for this adhesive agent layer to be provided to the entire surface of the film.

Next, the heat-resistant material 5 comprising the lid material film according to the present invention will be described. Uniaxially or biaxially oriented film, or uniaxially or biaxially oriented foam film is preferably employed. Materials which may be employed include the like of polypropylene resins, polyethylene resins, such as high-density polyethylene (HDPE), polyester resins, polyamide resins, etc., and the aforementioned materials are particularly preferably employed from the aspect of heat-resistance. Since this layer is not processed by laser in the present invention, this layer effectively acts as a strength-maintaining layer for the entire laminated structure, and especially serves to maintain strength in the tearing direction and in right-angle direction.

With the present invention, it is preferable that the uniaxially or biaxially oriented film have a thickness of approximately 10 to 40 $\mu$m, or uniaxial or biaxial oriented foam film have a thickness of approximately 30 to 150 $\mu$m.

Next, for the layer 6 which is not processed by the laser beam, aluminum foil or a vapor-deposition aluminum layer is preferably used. In the present invention, the laser processing is conducted from the sealant side of the film, so that the laser beam is obstructed and reflected by this layer, thereby keeping the outermost layer of heat resistant film with tearability from being processed by the laser beam. Also, since this layer itself is also unaffected by the laser beam, this layer also serves as a strength-maintaining layer in the event that aluminum foil is employed. In the aforementioned, it is preferable that the thickness of the aluminum foil be 5 $\mu$m to 20 $\mu$m.

Next, the layer 7 is processed by means of carbon dioxide gas laser beam so as to form grooves or slits therein which serve as tearing guides. Material particularly preferably used in comprising this layer includes the like of film of polyester resins, film of polyamide resins, or laminated constructions thereof.

In order for this layer to sufficiently serve as a guide layer, it is preferable that the thickness thereof be 20 $\mu$m or greater, since the tearing motion may stray from the guide if the thickness is 20 $\mu$m or less. In the present invention, a thickness of 30 $\mu$m to 100 $\mu$m is preferable.

Next, materials preferably used for the adhesive layer 8 in the present invention include, e.g., polyethylene, polypropylene, ethylene-vinyl acetate copolymers, or blends thereof, the material or materials being formed into a thermal fusion sealant layer. Also, easy-opening film or the like formed of adhesive polyolefine is also preferably employed. The thickness of this layer is preferably 10 $\mu$m to 100 $\mu$m. Further, it is needless to say that various types of viscous agents or hot-melt materials or the like may be coated to the entire surface thereof or coated according to a pattern corresponding to the portion to be sealed.

Now, description will be made regarding the method of lamination when manufacturing a multi-layer film using the aforementioned materials to use as a lid material film. The method of lamination of these films is not limited to any particular method, and it is needless to say that multi-layered lamination may be performed employing the co-extrusion process where the aforementioned layers are laminated via polyethylene or the like. Further, in the present invention, dry lamination where the layers are laminated via an adhesive agent may be employed, as well as combinations thereof, with the mode thereof not being particularly limited.

Next, the one or more laser-processed lines formed upon the lines which follow the aforementioned small supplying opening and are to be torn along when opening may be in the form of either continuous lines or non-continuous lines, and may be formed by means of carbon dioxide gas laser. A carbon dioxide gas laser is preferably used in the present invention, as such a laser allows for grooves or slits to be formed in a halfway-cut manner in a multi-layered film by cutting only a certain layer thereof, thereby obtaining an arrangement where unsealing can be performed along the grooves or slits.

In the present invention, the layers to be processed by laser are the layer 7 which serves as the tearing guide, and the adhesive layer 8, in which case the laser beam is applied from the direction of the innermost adhesive layer. The conditions for application of laser beam regarding the present invention may be adjusted as appropriate in accordance with the configuration of the multi-layered film, the thickness thereof, and the motion speed of the laser beam, and is not particularly limited.

Further, selection of whether to make the grooves or slits intermittent or non-intermittent, the size thereof, and the structure thereof, may be adjusted as appropriate by means of electrical control of the laser oscillation, and the formation of these grooves or slits in the present invention is not particularly limited regarding such formation. However, a line of intermittent perforations maintains linear tearability and the strength of the laminated film, and therefore is particularly preferable.

Also, in the present invention, there are several methods for conducting laser processing upon the lid material film for the toner container, such as a method where laser processing is conducted on a mother roll of already-laminated film, which is then cut as shown in FIG. 1 and thermally fused to the flanged opening portion of the formed container member, or, a method where laminated film serving as the lid material film is cut beforehand as shown in FIG. 1 and subjected to laser processing in sheet form, following which this sheet is thermally fused and fixed to the flanged opening portion of the formed container member, etc. However, the present invention is not particularly limited to any of these methods.

Next, description of an embodiment according to the present invention wherein laminated film is used a the lid material film for a toner container will be made with reference to FIGS. 3 and 4, which are perspective views of the toner container according to the present invention, showing a schematic configuration thereof.

Figure 3:
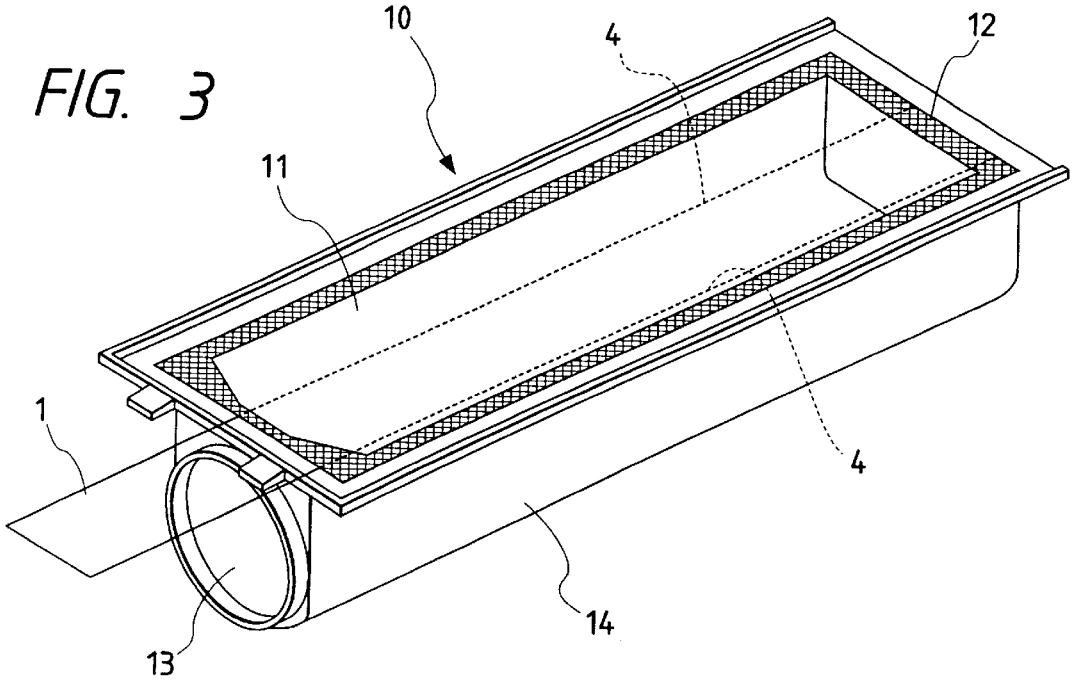
FIG. 3 is a perspective view of the configuration of a toner container.
Figure 4:
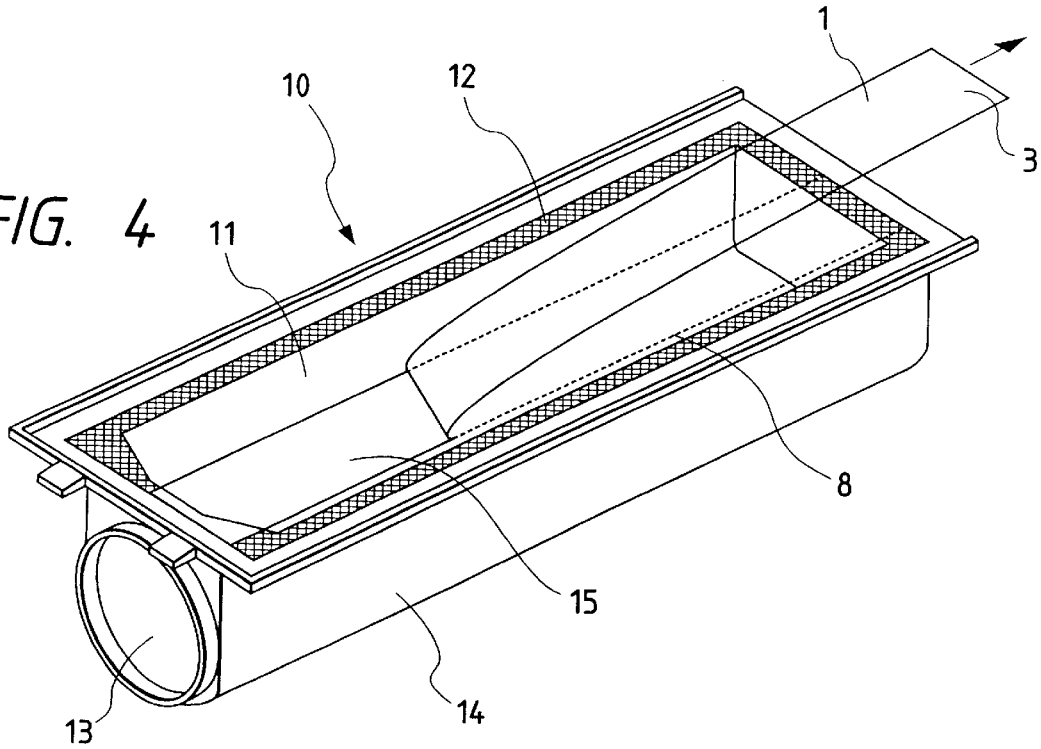
FIG. 4 is a perspective view of the configuration of a toner container.

Referring to FIGS. 3 and 4, the toner container 10 is provided with a toner supplying opening 11 for supplying toner to the developer unit, as well as a flanged portion 12 provided in the periphery of the aforementioned opening 11. Further comprising the toner container 10 is lid material film 1, which is bonded by adhesive means to the flanged portion 12 and the container member 14 upon which a toner filling opening 13 is provided on either one side thereof, the lid material film 1 thus sealing the toner supplying opening 11 and forming a toner supplying orifice 15, which is smaller than the aforementioned toner supplying opening.

A description will now be given regarding the container member 14, and the relation between the aforementioned container member 14 and the lid material film 1 for the toner container, and the construction of the lid material film 1 for the toner container is as described above.

As shown in FIGS. 3 and 4, the adhesive layer 8 or the adhesive agent layer 9 of the aforementioned toner container lid material film 1 is caused to face the surface of the flanged portion 12 formed around the toner supplying opening 11 of the toner container 10, the members facing each other being thermally fused by means of heat-sealing or the like, thus sealing the toner supplying opening. Then, the container member 14 is filled with the image forming toner through the toner filling opening 13 provided to one side thereof, the toner container 10 is mounted to the toner supplying section of an image-forming apparatus such as a copying machine or the like, following which the gripping portion 3 of the lid material film 1 for the toner container is gripped and pulled in the direction indicated by the arrow. Thus, part of the lid material film 1 for the toner container is peeled away according to the laser-processed lines 4, thereby forming a toner supplying orifice 15 from which toner is supplied to a predetermined location in the image-forming apparatus.

The precision of the dimensions of the opening thus formed is high, since the base film layer 5 is linearly torn along the laser-processed lines. Further, there is no leaking of toner powder, and the film strength is not reduced, since there is no laser processing conducted on the base film layer. Once the container member 14 has been filled with toner powder, the toner filling opening 13 is sealed with an appropriate material, e.g., paper, resin film, closure material formed of resin, or the like.

In the preceding, the container member 14 may be manufactured by means of injection molding or the like, using e.g., polystyrene resins, polypropylene resins, or other resins, or the like. Generally, an electrostatic preventive agent such as Carbon Black or the like is added to the material from which the container member is formed.

Next, further detailed description of the sealing film according to the present invention will be made with reference to embodiment. It is needless to say that these sealing films are to be used for sealing the opening of the aforementioned toner container.

Embodiment 1

Biaxially oriented polypropylene film manufactured by TOYOBO CO., LTD. (product name: PYLEN TO) (OPP), aluminum foil manufactured by NIPPON FOIL MFG. CO., LTD. (A1), biaxially oriented polyester film manufactured by TOYOBO CO., LTD. (product name: ESPET) (PET), and sealant manufactured by TOHCELLO CO., LTD (Product name: CMPS-008C) were formed into a laminated construction as described in the following, using a known dry lamination method employing urethane adhesive agents. The laminated member was formed of OPP of a thickness of 15 μm, A1 of a thickness of 7 μm, PET of a thickness of 50 μm, and sealant of a thickness of 30 μm.

Next, a carbon dioxide gas laser (manufactured by SYNRAD, INC., USA; machine model: 48-1-28W) set at a oscillating wavelength of 10.6 μm was used to irradiate the laminated film from the sealant side at an output of 10 W and at a transfer speed of 12 m per minute, thus forming a continuous processed groove in the PET layer of 50 μm in thickness and in the sealant layer of 30 μm in thickness.

Embodiment 2

Biaxial oriented polypropylene film manufactured by TOYOBO CO., LTD. (product name: PYLEN TO) (OPP), aluminum foil manufactured by NIPPON FOIL MFG. CO., LTD. (A1), biaxially oriented polyester film manufactured by TOYOBO CO., LTD. (product name: ESPET) (PET), biaxial oriented nylon film manufactured by UNITIKA LTD. (product name: EMBLEM) (NY), and sealant manufactured by TOHCELLO CO., LTD (Product name: CMPS-008C) were formed into a laminated construction as described in the following, using a known dry lamination method employing urethane adhesive agents. The laminated member was formed of OPP of a thickness of 15 μm, A1 of a thickness of 7 μm, PET of a thickness of 38 μm, NY of a thickness of 15 μm and sealant of a thickness of 30 μm.

Next, a carbon dioxide gas laser (manufactured by SYNRAD, INC., USA; machine model: 48-1-28W) set at a oscillating wavelength of 10.6 μm was used to irradiate the laminated film from the sealant side at an output of 10 W and at a transfer speed of 12 m per minute, thus forming a continuous processed groove in the PET/NY/sealant layer.

Embodiment 3

Figure 5:
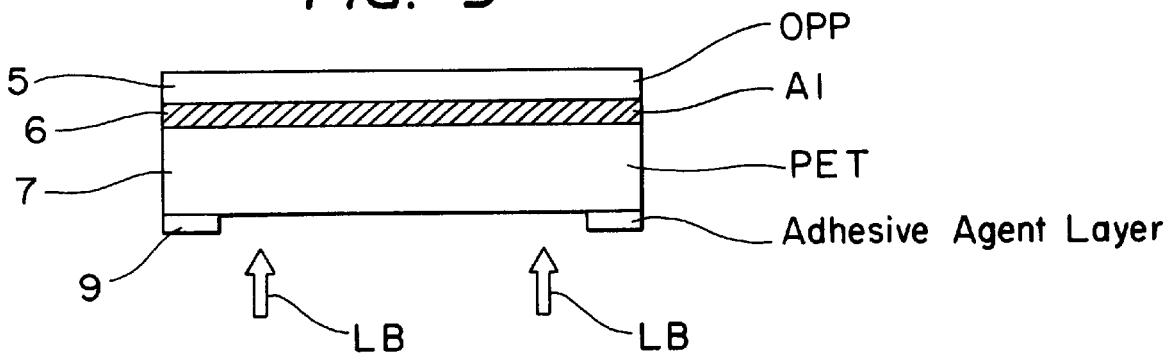
FIG. 5 illustrates a lid material film for a toner container before easy-tear portions are formed.

Biaxially oriented polypropylene film manufactured by TOYOBO CO., LTD. (product name: PYLEN TO) (OPP), aluminum foil manufactured by NIPPON FOIL MFG. CO., LTD. (A1), and biaxially oriented polyester film manufactured by TOYOBO CO., LTD. (product name: ESPET) (PET) were formed into a laminated construction as described in the following, using a known dry lamination method employing urethane adhesive agents, following which an adhesive agent was applied to the innermost layer as shown in the aforementioned FIG. 2B. The laminated member was formed of OPP of a thickness of 15 μm, A1 of a thickness of 7 μm, PET of a thickness of 50 μm, and adhesive agent layer of a thickness of 10 μm, see FIG. 5.

Next, a carbon dioxide gas laser (manufactured by SYNRAD, INC., USA; machine model: 48-1-28W) set at a oscillating wavelength of 10.6 μm was used to irradiate the laminated film from the adhesive side at an output of 10 W and at a transfer speed of 12 m per minute, thus forming a continuous processed groove in the PET layer of 50 μm in thickness.

Comparative example 1

Biaxially oriented polyester film manufactured by TOYOBO CO., LTD. (product name: ESPET) (PET), biaxially oriented nylon manufactured by IDEMITSU PETROCHEMICALS CO., LTD. (product name: UNIASLON) (ONy), and sealant manufactured by TOHCELLO CO., LTD. (Product name: CMPS-008C) were formed into a laminated construction as described in the following, using a known dry lamination method employing urethane adhesive agents. The laminated member was formed of PET of a thickness of 12 μm, ONy of a thickness of 15 μm, and sealant of a thickness of 30 μm.

Next, the carbon dioxide gas laser described in Embodiment 1 was used to irradiate the laminated film from the PET side at an output of 4 W and at a transfer speed of 30 m per minute, thus forming a continuous processed groove in the polyester layer and nylon layer.

Comparative example 2

Biaxially oriented polyester film manufactured by TOYOBO CO., LTD. (product name: ESPET) (PET), high density polyethylene manufactured by NIPPON PETROCHEMICALS CO., LTD. (product name: PARIRA HG) (HDPE), and sealant manufactured by TOHCELLO CO., LTD. (Product name: CMPS-008C) were formed into a laminated construction as described in the following, using a known dry lamination method employing urethane adhesive agents. The laminated member was formed of PET of a thickness of 16 μm, HDPE of a thickness of 20 μm, and sealant of a thickness of 30 μm.

Next, the carbon dioxide gas laser described in Embodiment 1 was used to irradiate the laminated film from the PET side at an output of 4 W and at a transfer speed of 30 m per minute, thus forming a continuous processed groove in the polyester layer alone.

Test example 1

The laminated film samples manufactured as described above were cut into the form shown in the aforementioned FIG. 1 following laser irradiation, the cut pieces were then thermally fused and fixed to the flanged portion formed in the periphery of the toner supplying opening of the container member formed primarily of polyethylene, this fusing being conducted at 140° C. from the sealant side for 3 seconds at a pressure of 4 kg, so as to obtain an arrangement as shown in the aforementioned FIG. 3. The edge of the turned-back portion was pulled in the direction of the arrow shown in the aforementioned FIG. 4, and the tearability of the film was examined.

Test example 2

The laminated film samples manufactured as described above were tested for tensile strength in the tearing direction and at right angles (TD direction) at the laser-processed sections. The tensile strength testing was conducted so that a portion 25 mm in width was subjected to a pulling speed of 100 m/min.

The results of the aforementioned test examples are as shown in Table 1:

TABLE 1

| | Linear tearability | Tensile strength |
|---|---|---|
| Embodiment 1 | ○ | 8.4 Kg |
| Embodiment 2 | ○ | 8.6 Kg |
| Embodiment 3 | ○ | 8.4 Kg |
| Comparative example 1 | ○ | 1.8 Kg |
| Comparative example 2 | X: delamination at seal portion | 4.2 Kg |

The samples of Embodiment 1, Embodiment 2, and Embodiment 3 each exhibited good linear tearability and strength. On the other hand, as can be seen from the results shown above, the sample of Comparative example 1 exhibited good linear tearability but lacked in strength in the TD direction since only the sealant remained to provide strength, and the sample of Comparative example 2 exhibited delamination between layers due to insufficient adhesion.

Thus, according to the present invention, it is possible to open an opening in lid material film sealing the toner powder discharge opening of a toner container storing powder toner or the like used in copying machine or the like, the opening being made at a predetermined location in a constant manner. In other words, a certain determined opening can be obtained regardless of the size of the toner container by means of a single sheet of lid material film, which is extremely useful from an industrial perspective.

Particularly, the present invention is advantageous in that a toner supplying orifice, which is opened over the toner supplying opening and is smaller than this toner supplying opening, is sealed by the lid material film forming this toner supplying orifice, this lid material film comprising a single sheet member. Thus, the sealing procedure of sealing the lid material film to the container member is completed with one step, thereby simplifying the sealing process and reducing costs.

Further, there is no delamination at the surface between the base layer and the guide layer, since the base layer is torn by the guide layer from behind as with a backing strip, due to the guide layer being formed inwards of the base layer.

While preferred embodiments of the present invention have been described, the present invention is by no means limited to such embodiments, but rather the present invention is capable of the widest range of embodiment without departing from the spirit or scope of the following claims.

What is claimed is:

1. A sealing film for sealing an opening of a containment body of a toner container for supplying toner to be used in an image forming apparatus, said sealing film comprising:

a base layer having a tearing directionality;

a guide layer having easy-tear portions for opening the opening, said easy-tear portions being laser-processed grooves formed in said guide layer by a processing laser beam, and said easy-tear portions extending along the tearing directionality; and a laser beam barrier layer provided between said base layer and said guide layer for shielding said base layer from the processing laser beam when the processing laser beam irradiates said guide layer from a side of said sealing film opposite a side at which said base layer is provided.

2. A sealing film according to claim 1, wherein said base layer is uniaxially oriented.

3. A sealing film according to claim 2, wherein said base layer comprises a foam substance.

4. A sealing film according to claim 3, wherein said base layer is of a thickness of 30 μm to 150 μm.

5. A sealing film according to claim 1, wherein said barrier layer is formed of aluminum.

6. A sealing film according to claim 5, wherein said farrier layer is formed by vapor deposition.

7. A sealing film according to claim 5, wherein said barrier layer is of a thickness of 5 μm to 20 μm.

8. A sealing film according to claim 1, wherein said guide layer is formed of a polyester resin, polyamide resin, or a lamination thereof.

9. A sealing film according to claim 8, wherein said guide layer is of a thickness of 30 μm to 100 μm.

10. A sealing film according to claim 1, wherein said processing laser beam is a carbon dioxide gas laser beam.

11. A sealing film according to claim 1, wherein an adhesive layer is provided on a surface of said guide layer opposite a surface facing said laser barrier layer.

12. A sealing film according to claim 11, wherein said adhesive layer is of a thickness of 10 μm to 100 μm.

13. A sealing film according to claim 12, wherein the processing laser beam removed a selected portion of said guide layer to form said groove.

14. A sealing film according to claim 1, wherein said base layer is biaxially oriented.

15. A sealing film according to claim 1, wherein said easy tear portions are perforations formed by irradiating the processing laser beam on said guide layer.

16. A sealing film according to claim 15, wherein said perforations are grooves.

17. A sealing film according to claim 15, wherein said perforations are slits.

18. A sealing film according to claim 15, wherein said perforations are also formed on an adhesive layer provided on a surface of said guide layer opposite a surface facing said laser barrier layer.

19. A sealing film according to claim 1, wherein said easy-tear portions are provided longitudinally at both side edges of said sealing film.

20. A sealing film according to claim 1, wherein said easy-tear portions are provided on a side opposed to the containment body when said sealing film is sealed to the toner containment body.

21. A sealing film according to claim 1, wherein the processing laser beam removes a selected portion of said guide layer to form said groove.

22. A toner container to be used in conjunction with an image forming apparatus, said toner container comprising:

a containment body for containing toner therein and having an opening to supply the toner therethrough; and a sealing film for sealing the opening to said containment body, said sealing film including:

a base layer having a tearing directionality;

a guide layer having easy-tear portions for opening the opening, said easy-tear portions being laser-processed grooves formed in laser beam on said guide layer by a processing laser beam, and said easy-tear portions extending along the tearing directionality; and a laser beam barrier layer provided between said base layer and said guide layer for shielding said base layer from the processing laser beam when the processing laser beam irradiates said guide layer from a side of said sealing film opposite a side at which said base layer is provided.

23. A toner container according to claim 22, wherein an adhesive layer is provided on a surface of said guide layer opposite to a surface facing said barrier layer for adhering said sealing film to said container.

24. A toner container according to claim 23, wherein said adhesive layer on a surface of said guide layer of said sealing film has a thickness of 10 $\mu$m to 100 $\mu$m.

25. A toner container according to claim 22, wherein at one end of said sealing film, a gripping portion for an operator to grip is provided.

26. A toner container according to claim 22, wherein said base layer of the sealing film is uniaxially oriented.

27. A toner container according to claim 26, wherein said base layer of the sealing film comprises a foam substance.

28. A toner container according to claim 27, wherein said base layer of said sealing film has a thickness of 30 $\mu$m to 150 $\mu$m.

29. A toner container according to claim 22, wherein said laser barrier layer of said sealing film is made of aluminum.

30. A toner container according to claim 29, wherein said laser barrier layer of said sealing film is formed by vapor deposition.

31. A toner container according to claim 29, wherein said laser barrier layer of said sealing film has a thickness of 5 $\mu$m to 20 $\mu$m.

32. A toner container according to claim 22, wherein said guide layer of said sealing film is formed of one of polyester resin, polyamide resin or a lamination thereof.

33. A toner container according to claim 32, wherein said guide layer of said sealing film has a thickness of 30 $\mu$m to 100 $\mu$m.

34. A toner container according to claim 22, wherein said processing laser beam for irradiating said guide layer of said sealing film is a carbon dioxide gas laser beam.

35. A toner container according to claim 22, wherein said base layer of said sealing film is biaxially oriented.

36. A toner container according to claim 22, wherein said easy-tear portions are perforations formed by irradiating the processing laser beam on said guide layer.

37. A toner container according to claim 22, wherein said easy-tear portions are provided longitudinally at both side edges of said sealing film.

38. A toner container according to claim 22, wherein said easy-tear portions are provided on a side opposed to the containment body when said sealing film is sealed to the toner containment body.

39. A toner container according to claim 36, wherein said perforations are grooves.

40. A toner container according to claim 36, wherein said perforations are slits.

41. A toner container according to claim 36, wherein said perforations are also formed on an adhesive layer provided on a surface of said guide layer opposite a surface facing said laser barrier layer.

42. A sealing film for sealing an opening of a containment body of a toner container for supplying toner to be used in an image forming apparatus, said sealing film comprising:

a base layer having a tearing directionality;

a guide layer having easy-tear portions for opening the opening, said easy-tear portions being laser-processed grooves formed in said guide layer by a processing layer beam and extending in the tearing directionality; and a laser barrier layer provided between said base layer and said guide layer;

wherein said easy-tear portions are formed by irradiating said sealing film with the processing laser beam from a side, opposed to a side on which said base layer is provided, of said sealing film, said processing laser beam having a predetermined oscillating wavelength and a predetermined output, while providing a relative movement between said sealing film and the processing laser beam in the predetermined directionality, and wherein said laser barrier layer shields said base layer from the processing laser beam when said sealing film is irradiated by the processing laser beam.

43. A sealing film according to claim 42, wherein said predetermined oscillating wavelength is 10.6 $\mu$m, said predetermined output is 10 W and a speed of said relative movement is 12 m per minute.

44. A toner container to be used in conjunction with an image forming apparatus for forming an image with toner, said toner container comprising:

a containment body for containing the toner therein;

an opening provided in said containment body for supplying the toner to the image forming apparatus;

a flanged portion surrounding said opening; and a sealing film attached to said flanged portion for sealing said opening, said sealing film having a base layer having a tearing directionality, a guide layer having easy-tear portions for opening said opening, said easy-tear portions being laser-processed groves formed in the tearing directionality by a processing laser beam, and a laser barrier layer provided between said base layer and said guide layer, wherein said easy-tear portions are formed by irradiating said sealing film with the processing laser beam from a side, opposed to a side on which said base layer is provided, of said sealing film, the processing laser beam having a predetermined oscillating wavelength and a predetermined output, while providing a relative movement between said sealing film and the processing laser beam in the tearing directionality, and wherein said laser barrier layer shields said base layer from said laser beam when said sealing film is irradiated by the processing laser beam.

* * * * *

UNITED STATES PATENT AND TRADEMARK OFFICE

CERTIFICATE OF CORRECTION

PATENT NO. : 6,188,421 B1
DATED : February 13, 2001
INVENTOR(S) : Kazuyoshi Hayashi et al.

It is certified that error appears in the above-identified patent and that said Letters Patent is hereby corrected as shown below:

Column 1,
Lines 21 and 25, "apparatus" should read -- apparatus, --.

Column 4,
Line 49, "a the" should read -- as the --.

Column 5,
Line 55, "TO)" should read -- OT) --.

Column 6,
Line 7, "Biaxial" should read -- Biaxially --;
Lines 8 and 29, "TO)" should read -- OT) --;
Line 40, "μm, see FIG. 5." should read -- μm. See FIG. 5. --.

Column 8,
Line 37, "farrier" should read -- barrier --; and
Line 57, "easy" should read -- easy- --.

Column 9,
Line 19, "laser beam on" should be deleted.

Column 10,
Line 20, "layer" should read -- laser --.

Signed and Sealed this

Twenty-fifth Day of December, 2001

*Attest:*

*Attesting Officer*

JAMES E. ROGAN
*Director of the United States Patent and Trademark Office*